US007430379B2

(12) United States Patent
Lee

(10) Patent No.: US 7,430,379 B2
(45) Date of Patent: Sep. 30, 2008

(54) IMAGE FORMING APPARATUS HAVING A DISCRIMINATION FUNCTION ABOUT REFILLED TONER AND METHOD THEREOF

(75) Inventor: Dae-Yel Lee, Suwon-si (KR)

(73) Assignee: Samsung Electronics Co., Ltd., Suwon-Si, Gyeonggi-do (KR)

( * ) Notice: Subject to any disclaimer, the term of this patent is extended or adjusted under 35 U.S.C. 154(b) by 188 days.

(21) Appl. No.: 11/289,302

(22) Filed: Nov. 30, 2005

(65) Prior Publication Data

US 2006/0127105 A1 Jun. 15, 2006

(30) Foreign Application Priority Data

Dec. 10, 2004 (KR) ..... 10-2004-0104327

(51) Int. Cl.
*G03G 15/00* (2006.01)
*G03G 15/08* (2006.01)
*G03G 21/00* (2006.01)

(52) U.S. Cl. ..... 399/12; 399/27

(58) Field of Classification Search ..... 399/12, 399/110, 111, 119, 262, 24, 25, 26, 27; 347/19, 347/49, 86

See application file for complete search history.

(56) References Cited

U.S. PATENT DOCUMENTS

| | | | | |
|---|---|---|---|---|
| 6,385,407 | B1 | 5/2002 | Inose | |
| 2002/0076224 | A1* | 6/2002 | Pollocks, Jr. | 399/12 |
| 2002/0085847 | A1* | 7/2002 | Yoshida et al. | 399/12 |
| 2002/0164168 | A1* | 11/2002 | Hayakawa | 399/12 |
| 2003/0031475 | A1* | 2/2003 | Asakura | 399/12 |
| 2005/0078969 | A1* | 4/2005 | Kikuchi | 399/12 |
| 2005/0141901 | A1* | 6/2005 | Lee | 399/12 |
| 2005/0163514 | A1* | 7/2005 | Hwang | 399/12 X |
| 2005/0254835 | A1* | 11/2005 | Takei | 399/12 |
| 2006/0034625 | A1* | 2/2006 | Kajikawa | 399/12 |

FOREIGN PATENT DOCUMENTS

| | | |
|---|---|---|
| CN | 1437077 | 8/2003 |
| EP | 0 395 320 | 4/1990 |
| JP | 11-237816 | 8/1999 |
| JP | 2000-326518 | 11/2000 |
| KR | 2001-0049000 | 6/2001 |
| KR | 10-20010084135 A | 9/2001 |
| KR | 1020040047150 A | 6/2004 |

* cited by examiner

*Primary Examiner*—Sophia S Chen
(74) *Attorney, Agent, or Firm*—Roylance, Abrams, Berdo & Goodman, LLP

(57) ABSTRACT

An image forming apparatus capable of determining whether a toner cartridge is a refilled toner cartridge and method thereof is provided. The image forming apparatus includes a cartridge mount part configured to receive a toner cartridge with a toner memory. The toner memory stores information for determining whether a toner cartridge is a refilled toner cartridge. The image forming apparatus further includes a display part for displaying messages according to the determination information in the toner memory, a control part for reading the determination information from the toner memory and determining toner cartridge condition. The control part directs output of the messages, thus indicating toner cartridge condition. Therefore, use of unauthorized refill toner cartridges can be prevented.

17 Claims, 4 Drawing Sheets

IMAGE FORMING APPARATUS HAVING A DISCRIMINATION FUNCTION ABOUT REFILLED TONER AND METHOD THEREOF

PRIORITY

This application claims the benefit under 35 U.S.C. § 119 (a) of Korean Patent Application No. 2004-104327 filed on Dec. 10, 2004, in the Korean Intellectual Property Office, the entire disclosure of which is hereby incorporated by reference.

BACKGROUND OF THE INVENTION

1. Field of the Invention

The present invention relates to an image forming apparatus comprising a discrimination function about a refilled toner and method thereof. More particularly, the present invention relates to an image forming apparatus with a discrimination function about a refilled toner that determines whether a toner cartridge is refilled using a toner memory provided in the toner cartridge, and method thereof.

2. Description of the Related Art

An image forming apparatus outputs print data on paper and serves as a printer, a copier and a facsimile machine, or a multi-functional peripheral device integrating the printer, copier and facsimile machine. The image forming apparatus applies a developer, such as toner, to paper in order to put the print data onto the paper.

The toner is contained in a toner cartridge, and the toner cartridge is mounted in the image forming apparatus. The toner is consumed as the image forming apparatus performs printing, and after a certain amount of printing is performed the toner is entirely consumed, thus requiring the user to replace the toner cartridge.

Users replace toner cartridges with a refilled toner cartridge that is much cheaper than a genuine toner cartridge. The toner cartridge is a consumable product, which cannot be used after it has been entirely consumed. Some manufacturers collect used toner cartridges in order to refill them with toner, and then distribute them in large quantities at a reduced price.

If a user mounts a refilled toner cartridge in an image forming apparatus, print image quality deteriorates, and accelerated wear on the image forming apparatus causes frequent machine downtime, thus the lifespan of a refilled toner cartridge may be shortened. Up to now, refilled toner cartridges have been distributed in large quantities. Thus, there is a need for a method and apparatus for preventing the use of refilled toner cartridges in an image forming apparatus.

SUMMARY OF THE INVENTION

The present invention has been developed in order to address the above drawbacks and other problems associated with a conventional image forming apparatus and toner cartridge arrangement. An aspect of the present invention comprises an image forming apparatus for determining if a toner cartridge is refilled based on information recorded in a toner memory. If the toner cartridge is refilled, the image forming apparatus does not perform printing and indicates the condition of a toner cartridge such that the cartridge can be prevented from being mounted in the image forming apparatus.

According to another aspect of the present invention, an image forming apparatus comprises a cartridge mounting part comprising a toner cartridge with a toner memory having stored therein determination information for identifying refilled toner cartridges, a display part for displaying a certain message on a screen according to the determination information, and a control part reading out the determination information from the toner memory to determine toner cartridge condition. The control part then outputs a certain message corresponding to the toner cartridge condition.

The device may further comprise a storage part for storing a serial number, and a print driving part for printing.

The determination information may comprise at least one of information corresponding to a manufacturing date of the toner cartridge, information corresponding to a remaining amount of toner contained in the toner cartridge, and a serial number.

The control part may check if the toner memory contains product information when the toner cartridge is being mounted to the cartridge mount part. If the toner memory contains product information, the control part determines that the toner cartridge is a new product, deletes the product information, and records the serial number of the cartridge in the toner memory.

If the toner memory does not contain product information, the control part determines that the toner cartridge is not a new product and checks whether the toner memory has a serial number for the cartridge. If the toner memory has no serial number for the cartridge, the control part then determines whether the toner cartridge is in a toner low condition with reference to the toner remaining amount information.

If the toner cartridge is in a toner low condition, the control part then directs the print driving part to not perform printing, and causes the display part to output a message indicating a print disable condition.

The toner memory may comprise a Customer Replacement Unit Monitor (CRUM).

According to another aspect of the present invention, a method is disclosed for identifying a refilled toner cartridge within an image forming apparatus with a certain serial number. The method comprises (a) sensing whether a toner cartridge with a certain toner memory is mounted, (b) determining whether the toner cartridge is a new product, (c) determining whether the toner memory has a serial number, (d) determining whether the toner cartridge is in a toner low condition, and (e) maintaining a print disable condition if the toner cartridge is not a new product, there is no serial number in the toner memory, or the toner cartridge is in a toner low condition.

The method may further comprise outputting a message corresponding to the print disable condition.

In another aspect of the present invention step (e) may comprise recording the serial number to toner memory if the toner cartridge is not a new product, there is already an existing serial number stored in the toner memory, and the toner cartridge is not in a toner low condition, and maintaining a print enable condition.

In another aspect of the present invention step (d) may comprise determining whether the toner cartridge is in a toner low condition when the toner cartridge is not a new product and the toner memory has a serial number, and outputting a message corresponding to the toner low condition if it is determined that the toner cartridge is in the toner low condition.

The method may further comprise maintaining the print enable condition if the toner cartridge is not in the toner low condition.

In another aspect of the present invention step (c) may comprise recording the serial number in the toner memory if the toner cartridge is a new product, determining whether the toner cartridge is in the toner low condition, and outputting a message corresponding to the toner low condition if the toner cartridge is in the toner low condition.

The method may further comprise maintaining the print enable condition if the toner cartridge is not in the toner low condition.

BRIEF DESCRIPTION OF THE DRAWINGS

The above aspects and exemplary features of the present invention will be more apparent by describing certain embodiments of the present invention with reference to the accompanying drawings, in which.

Throughout the drawings, like reference numbers should be understood to refer to like elements, features, and structures.

DETAILED DESCRIPTION OF EXEMPLARY EMBODIMENTS

The matters exemplified in this description are provided to assist in a comprehensive understanding of various exemplary embodiments of the present invention disclosed with reference to the accompanying figures. Accordingly, those of ordinary skill in the art will recognize that various changes and modifications of the exemplary embodiments described herein can be made without departing from the scope and spirit of the claimed invention. Descriptions of well-known functions and constructions are omitted for clarity and conciseness.

Figure 1:
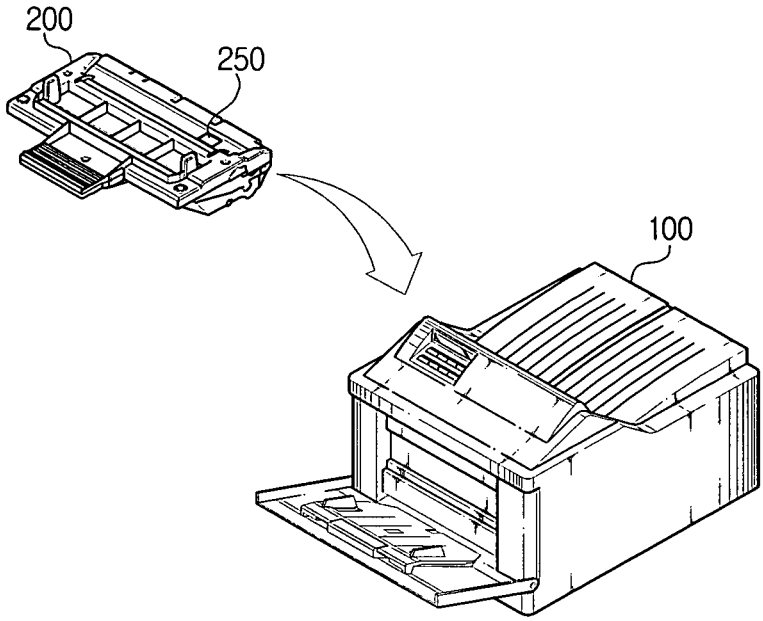
FIG. 1 depicts a view of an image forming apparatus and a toner cartridge to be mounted to the image forming apparatus according to an exemplary embodiment of the present invention.

FIG. 1 depicts a view of an image forming apparatus and a toner cartridge to be mounted to the image forming apparatus according to an exemplary embodiment of the present invention. In reference to FIG. 1, the image forming apparatus 100 comprises a toner cartridge 200 containing toner for printing. The toner cartridge 200 comprises a toner memory 250 with discrimination information for determining whether the toner cartridge 200 is refilled. If the toner cartridge 200 is mounted, the image forming apparatus 100 reads the discrimination information from the toner memory 250, and then determines whether the toner cartridge 200 is refilled.

If it is determined that the toner cartridge 200 is refilled, the image forming apparatus 100 is disabled from printing and indicates a message corresponding to a print disable condition in order to inform a user that the present-mounted toner cartridge 200 is refilled.

Figure 2:
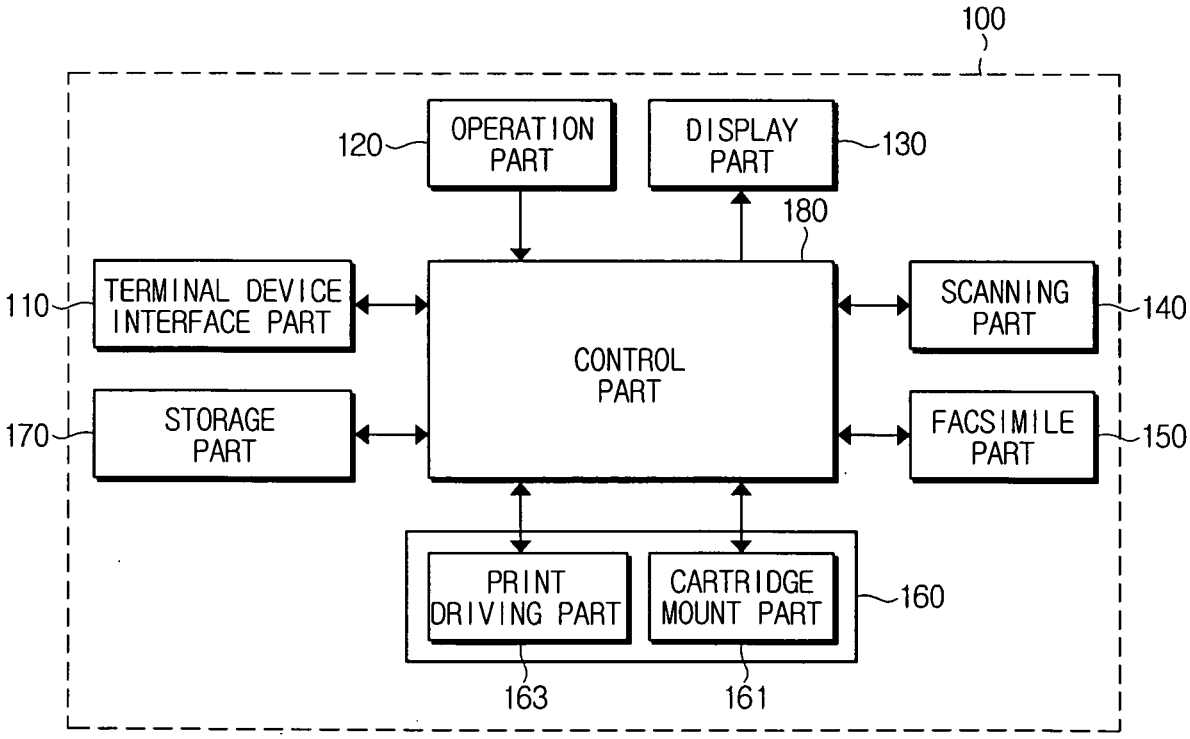
FIG. 2 illustrates a block diagram of an image forming apparatus according to an exemplary embodiment of the present invention.

FIG. 2 illustrates a block diagram of an image forming apparatus according to an exemplary embodiment of the present invention. Referring to FIG. 2, the image forming apparatus 100 comprises a terminal device interface part 10, an operation part 120, a display part 130, a scanning part 140, a facsimile part 150, a printing part 160, a storage part 170, and a control part 180.

The terminal device interface part 110 is capable of being connected to a terminal device (not shown) such as a PC or a laptop computer to provide a bi-directional communication interface with the terminal device. The terminal device interface part 110 transmits commands and data from the terminal device to the control part 180, and transmits information from the control part 180 to the terminal device.

The operation part 120 is a user interface means, and comprises a plurality of keys for controlling operations of the image forming apparatus 100. A user can set diverse functions of the image forming apparatus 100 through the operation part 120.

The display part 130 is also a user interface means, and comprises a display device such as a Liquid Crystal Display (LCD) for showing operations of the image forming apparatus 100. For example, according to an exemplary embodiment of the present invention, if the toner is in a low condition of the toner cartridge 200 mounted in the image forming apparatus 100, the display part 130 outputs messages corresponding to the toner low condition and print disable condition to inform a user of the condition of the toner cartridge.

The scanning part 140 scans an image according to the control of the control part 180 so as to generate image data. The generated image data is stored to the storage part 170, and then is printed at the print part 160 according to the control part 180, or transmitted via the terminal device interface part 110 so as to be stored or edited.

The facsimile part 150 receives facsimile data transmitted via a telephone communication network. The received facsimile data is printed on print paper according to control part 180, or stored to the storage part 170.

The print part 160 comprises a cartridge mount part 161 capable of receiving a toner cartridge for printing and a print driving part 163 for performing printing. The print driving part 163 prints the print data generated from the terminal device according to the control part 180. Further, according to the control of the control part 180, the print driving part 163 prints the image data scanned from the aforementioned scanning part 140 and the facsimile data output from the aforementioned facsimile part 150.

The cartridge mount part 161 is configured to receive the toner cartridge 200 containing the toner for printing, and the toner cartridge 200 comprises the toner memory 250 with predetermined information. If the toner cartridge 200 is mounted, the cartridge mount part 161 transmits to the control part 180 a signal informing of the mounting of the toner cartridge 200.

Control programs for controlling the image forming apparatus 100 and fonts for printing are stored within storage part 170, which provides storage for converting data when printing. The image data generated from the scanning part 140 and the facsimile data received from the facsimile part 150 are temporarily stored to the storage part 170. Additionally, a serial number corresponding to the image forming apparatus 100 is stored to the storage part 170 according to an exemplary embodiment of the present invention.

The control part 180 directs the print part 160 to print the print data according to the print command transmitted from the terminal device. The control part 180 also directs the scanning part 140 to scan an image according to the scan control command transmitted from the terminal device. The control part 180 directs the terminal device interface part 110 to store the image data generated from the scanning part 140 to the storage part 170, or to transmit the image data to the terminal device.

If the cartridge mount part 161 transmits a signal in response to the mounting of the toner cartridge 200, the control part 180 reads various information from the toner memory 250 to determine the condition of the toner cartridge 200. The control part 180 directs the display part 130 to output the condition of the toner cartridge 200 in the form of messages in response to the toner low condition and the print disable condition. The control part 180 directs the print driving part 163 to not perform printing under the print disable condition.

Figure 3:
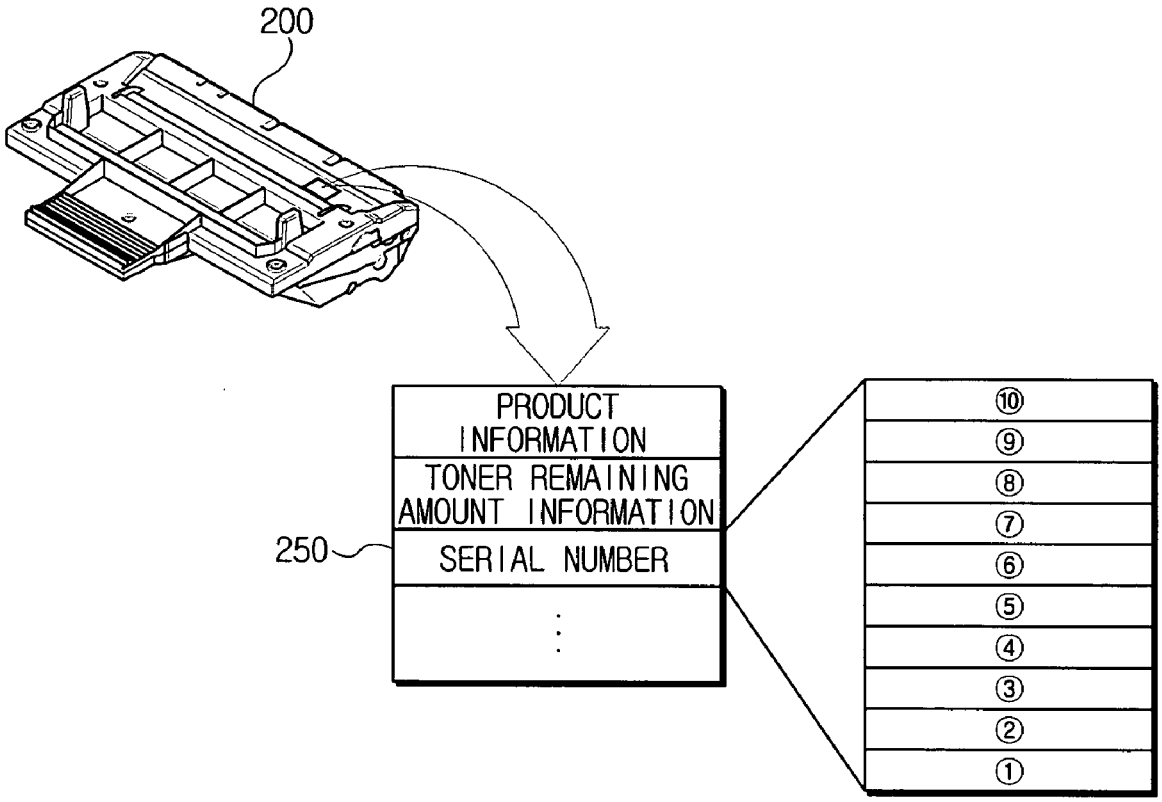
FIG. 3 depicts a view of a toner memory of a toner cartridge to be mounted to an image forming apparatus according to an exemplary embodiment of the present invention.

FIG. 3 depicts a view of an example of a toner memory of a toner cartridge to be mounted to an image forming apparatus according to an exemplary embodiment of the present invention. Referring to FIG. 3, the toner cartridge 200 to be mounted to the image forming apparatus 100 comprises a toner memory 250. The discrimination information for determining whether the toner cartridge 200 is refilled is stored to the toner memory 250. The discrimination information comprises product information corresponding to the manufacturing data of the toner cartridge 200, information on the remaining amount of toner contained in the toner cartridge 200, and serial number stored in the storage part 170.

The product information is the same as the manufacturing data of the toner cartridge 200. The product information is recorded on the toner memory 250 during manufacturing, and deleted when the toner cartridge 200 is mounted to the image forming apparatus 100. The product information is recorded only on new product cartridges.

The information on the remaining amount of toner comprises printing page count information and toner dot count information. The printing page count information and the toner dot count information are information on the amount of toner remaining in the toner cartridge 200 after printing. The control part 180 detects the replacement time of the toner cartridge 200 through the toner remaining amount information.

The printing page count information comprises the maximum number of printable pages using the toner contained in the toner cartridge 200 and the number of printed and accumulated papers. When printing, the image forming apparatus 100 counts the number of papers printed and compares the counted number of pages with the maximum number of pages recorded at the toner memory 250. When the number of counted pages is the same as the maximum, the image forming apparatus 100 informs the user of the toner low condition.

The toner dot count information comprises the maximum amount of printable dots using the toner contained in the toner cartridge 200 and the number of printing dots printed and accumulated. When printing, the image forming apparatus 100 counts the number of printing dots printed and compares the counted number of printing dots with the maximum number of dots recorded at the toner memory 250. When the number of printing dots is the same as the maximum, the image forming apparatus 100 informs the user of the toner low condition of the toner cartridge 200.

Serial numbers are uniquely provided for every image forming apparatus 100. If a toner cartridge 200 is mounted to the cartridge mount part 161, the control part 180 determines whether the serial number corresponding to the image forming apparatus 100 exist in the toner memory 250. If not, the control part 180 records the serial number in the toner memory 250. That is, the control part 180 records the serial number in the toner memory 250 if there is not a serial number corresponding to the image forming apparatus 100 prior to the toner low condition of the toner cartridge 200.

Since there is a limit to the amount of toner memory 250 available, the number of serial numbers that can be stored in the toner memory 250 is also limited. As shown in FIG. 3, if the toner memory 250 has storage for ten serial numbers, the first-stored serial number ① is deleted from storage when the eleventh serial number is recorded to the toner memory 250. In particular, if the number of serial numbers exceed the amount of available storage space, a First Input First Output (FIFO) rule is applied so that the serial numbers are sequentially deleted as the new serial numbers are stored.

An example of the information stored in the toner memory 250 comprises a Customer Replacement Unit Monitor (CRUM), and the control part 100 can determines whether the toner cartridge 200 is refilled through the determination information stored at the CRUM.

Figure 4:
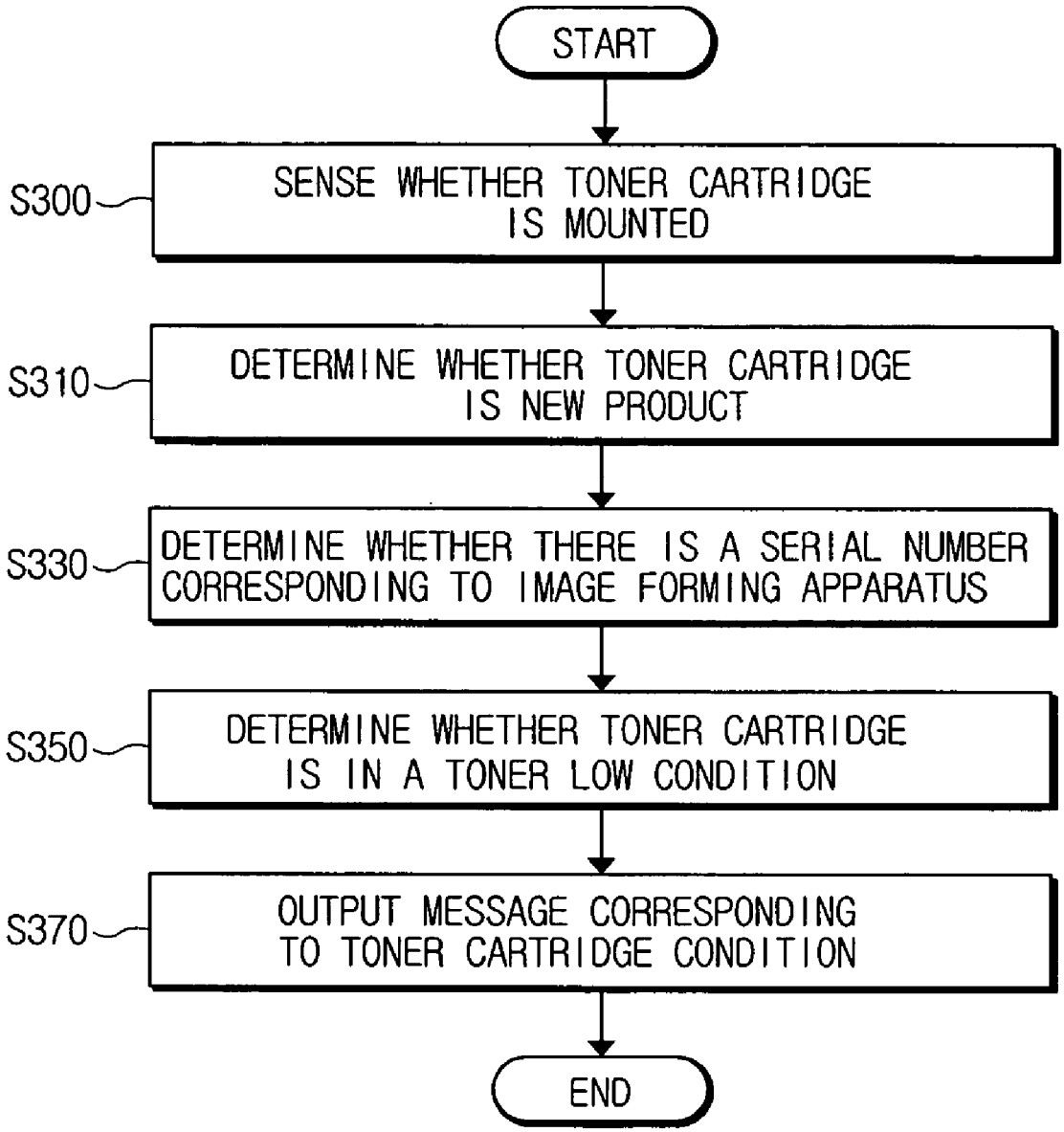
FIG. 4 shows a flowchart for explaining operations of an image forming apparatus according to an exemplary embodiment of the present invention.

FIG. 4 shows a flowchart for explaining operations of an image forming apparatus according to an exemplary embodiment of the present invention. Referring to FIG. 4, when a user mounts the toner cartridge 200 to the cartridge mount part 161, the cartridge mount part 161 generates a signal informing the control part 180 of the toner cartridge 200 mounting. The control part 180 receives the signal from the cartridge mount part 161 to sense the mounting of the toner cartridge 200 (S300).

The control part 180 determines whether the toner cartridge 200 is a new product according to existence of the product information recorded in the toner memory 250 (S310). In other words, if product information is stored in the toner memory 250, it is determined that the toner cartridge 200 is a new product; if there is no product information in the toner memory 250, it is determined that the toner cartridge 200 is not a new product (S310).

The control part 180 determines whether there is a serial number corresponding to the image forming apparatus 100 in the toner memory 250 (S330).

The control part 180 determines whether the toner cartridge 200 is in a toner low condition with reference to the remaining amount of toner stored in the toner memory 250 (S350).

The control part 180 directs the print driving part 163 to maintain a print disable condition if it is determined that the toner cartridge 200 is not a new product, there are no serial numbers for an image forming apparatus 100 in the toner memory 250, or the toner cartridge 250 is in a toner low condition. Further, the control part 180 outputs a message corresponding to the print disable condition to inform a user of the toner cartridge 200 being a refilled or unauthorized cartridge (S370).

Figure 5:
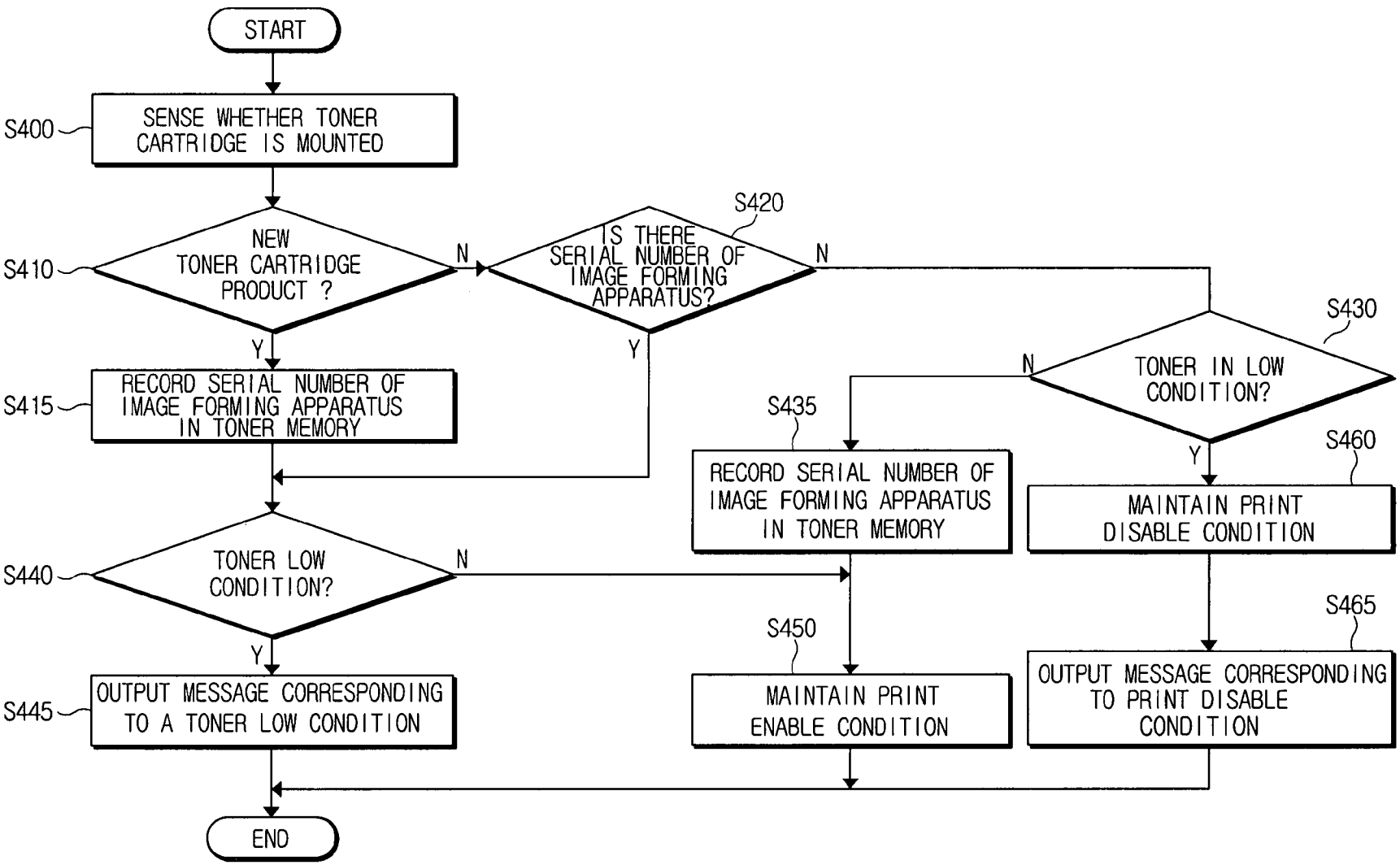
FIG. 5 shows a detailed flowchart for explaining operations of an image forming apparatus according to an exemplary embodiment of the present invention.

FIG. 5 shows a detailed flowchart for explaining operations of an image forming apparatus according to an exemplary embodiment of the present invention. Referring to FIG. 5, the control part 180 senses via a signal generated from the cartridge mount part 161 whether the toner cartridge 200 is mounted (S400).

The control part 180 determines that the toner cartridge 200 is a new product if there is product information in the toner memory 250, and determines that the toner cartridge 200 is not a new product if the product information is not in the toner memory 250 (S410). If it is determined that the toner cartridge 200 is a new product, the control part deletes the product information in the toner memory 250 and records the serial number of the image forming apparatus 100 in the toner memory 250 (S415). If it is determined that the toner cartridge 200 is not a new product, the control part 180 checks whether the serial number of the image forming apparatus 100 is in the toner memory 250 (S420).

If it is determined that the serial number of the image forming apparatus 100 is in the toner memory 250, the control part 180 determines whether the toner cartridge 200 is in a toner low condition (S440). If it is determined that the toner cartridge 200 is in a toner low condition, the control part 180 outputs a message indicating a toner low condition (S445). If the toner cartridge 200 is not in a toner low condition, the control part 180 directs the print driving control part 163 to maintain the print enable condition (S450).

If there are no serial numbers for the image forming apparatus 100 in the toner memory 250 per step S420, the control part 180 reads the remaining amount of toner from the toner memory 250 to determine whether the toner cartridge 200 is in a low condition (S430). If it is determined that the toner cartridge 200 is in a toner low condition, the control part 180 directs the print driving part 163 to disable printing (S460). Additionally, the control part 180 outputs a message corresponding to the print disable condition, such as 'printing is disabled because the toner cartridge is an unauthorized refilled cartridge' (S465).

If it is determined that the toner cartridge 200 is not in a toner low condition per step S430, the control part 180 records the serial number of the image forming apparatus 100 in the toner memory 250 (S435), and directs the print driving part 163 to maintain a print enable condition (S450).

According to the above processes, a user can check the condition of the toner cartridge 200 mounted in the image forming apparatus 100.

As described above, if exemplary embodiments of the present invention are applied, it can be determined whether the toner cartridge 200 is a refilled cartridge by accessing the determination information of the refilled toner in the toner memory 250. Therefore, use of a refilled toner cartridge can be prevented, and the condition of the toner cartridge 200 displayed for a user to be notified. Thus, deterioration of print image quality and accelerated wear on the image forming apparatus can be prevented because unauthorized toner cartridges are prevented from use.

While the invention has been particularly shown and described with reference to certain exemplary embodiments thereof, it will be understood by those of ordinary skill in the art that various changes in form and details may be made therein without departing from the spirit and scope of the present invention as defined by the appended claims.

What is claimed is:

1. An image forming apparatus, comprising:

a cartridge mount part configured to receive a toner cartridge comprising a toner memory storing information for determining whether the toner cartridge is a refilled toner cartridge;

a display part for displaying a message on a screen according to the information stored in the toner memory;

a control part for reading the information from the toner memory to determine a toner cartridge condition, the control part outputting the message corresponding to the toner cartridge condition;

a storage part for storing a serial number; and a print driving part for printing;

wherein the information stored in the toner memory comprises at least one of a product information comprising a manufacturing date of the toner cartridge, a toner remaining amount information corresponding to a remaining amount of toner contained in the toner cartridge, and the serial number; and wherein the control part checks if the toner memory stores the product information when the toner cartridge is mounted to the cartridge mount part, and when the toner memory stores the product information, the control part determines that the toner cartridge is a new product, deletes the stored product information, and records the serial number in the toner memory.

2. The apparatus as claimed in claim 1, wherein, if the toner memory does not have the product information stored therein, the control part determines that the toner cartridge is not a new product and determines whether the toner memory stores the serial number.

3. The apparatus as claimed in claim 2, wherein, if the toner memory does not have the serial number stored therein, the control part determines whether the toner cartridge is in a toner low condition with reference to the toner remaining amount information.

4. The apparatus as claimed in claim 3, wherein, if the toner cartridge is in the toner low condition, the control part directs the print driving part to not print, and directs the display part to output a message indicating a print disable condition.

5. The apparatus as claimed in claim 1, wherein the toner memory comprises a Customer Replacement Unit Monitor (CRUM).

6. A method for determining whether a toner cartridge is a refilled toner cartridge, the method comprising:

(a) sensing whether a toner cartridge is mounted to an image forming apparatus, the toner cartridge comprising toner memory;

(b) determining whether the toner cartridge is a new product;

(c) determining whether the toner memory stores an image forming apparatus serial number;

(d) determining whether the toner cartridge is in a toner low condition;

(e) maintaining a print disable condition if at least one of (1) the toner cartridge is not a new product, (2) there is no image forming apparatus serial number in the toner memory, and (3) the toner cartridge is in the toner low condition; and (f) recording the image forming apparatus serial number in the toner memory if the toner cartridge is not a new product, there is no serial number in the toner memory, and the toner cartridge is not in the toner low condition; and (g) maintaining a print enable condition.

7. The method as claimed in claim 6, further comprising outputting a message corresponding to the print disabled condition.

8. The method as claimed in claim 6, wherein step (d) comprises:

determining whether the toner cartridge is in the toner low condition when the toner cartridge is not a new product and the toner memory stores the serial number; and outputting a message corresponding to the toner low condition if it is determined that the toner cartridge is in the toner low condition.

9. The method as claimed in claim 8, further comprising:

maintaining the print enable condition if the toner cartridge is not in the toner low condition.

10. The method as claimed in claim 6, wherein step (c) comprises:

recording the image forming apparatus serial number in the toner memory when the toner cartridge is a new product;

determining whether the toner cartridge is in the toner low condition; and outputting a message corresponding to the toner low condition if the toner cartridge is in the toner low condition.

11. The method as claimed in claim 10, further comprising:

maintaining the print enable condition if the toner cartridge is not in the toner low condition.

12. A method for determining whether a toner cartridge is a refilled toner cartridge, the method comprising:

(a) sensing whether a toner cartridge is mounted to an image forming apparatus, the toner cartridge comprising toner memory;

(b) determining whether the toner cartridge is a new product;

(c) determining whether the toner memory stores an image forming apparatus serial number;

(d) recording the image forming apparatus serial number in the toner memory when the toner cartridge is a new product;

(e) determining whether the toner cartridge is in a toner low condition;

(f) outputting a message corresponding to the toner low condition if the toner cartridge is in the toner low condition; and (g) maintaining a print disable condition if at least one of (1) the toner cartridge is not a new product, (2) there is no image forming apparatus serial number in the toner memory, and (3) the toner cartridge is in the toner low condition.

13. The method as claimed in claim 12, further comprising outputting a message corresponding to the print disabled condition.

14. The method as claimed in claim 12, wherein step (g) comprises:

recording the image forming apparatus serial number in the toner memory if the toner cartridge is not a new product, there is no serial number in the toner memory, and the toner cartridge is not in the toner low condition; and maintaining a print enable condition.

15. The method as claimed in claim 12, wherein step (e) comprises determining whether the toner cartridge is in the toner low condition when the toner cartridge is not a new product and the toner memory stores the serial number; and outputting a message corresponding to the toner low condition if it is determined that the toner cartridge is in the toner low condition.

16. The method as claimed in claim 15, further comprising:

maintaining the print enable condition if the toner cartridge is not in the toner low condition.

17. The method as claimed in claim 12, further comprising:

maintaining the print enable condition if the toner cartridge is not in the toner low condition.

* * * * *